United States Patent [19]

Jurczenia et al.

[11] Patent Number: 4,646,933

[45] Date of Patent: Mar. 3, 1987

[54] VENTED PLASTIC CAN AND TIN LID THEREFOR

[75] Inventors: Edward Jurczenia, Greenwich; Alton W. Adams, Trumbull, both of Conn.

[73] Assignee: United States Tobacco Company, Greenwich, Conn.

[21] Appl. No.: 785,158

[22] Filed: Oct. 7, 1985

[51] Int. Cl.[4] ..... B65D 51/16

[52] U.S. Cl. ..... 220/366; 220/352

[58] Field of Search ..... 220/352, 353, 366, 307

[56] References Cited

U.S. PATENT DOCUMENTS 3,042,247 7/1962 Bonnet ..... 220/366

3,874,556 4/1975 Finkelston, Jr. ..... 220/352

*Primary Examiner*—George T. Hall

*Attorney, Agent, or Firm*—Fred A. Keire

[57] ABSTRACT

A plastic can has been disclosed which is designed to retain freshness of the contents and provide, during the lidding operation, an easy placement of the lid thereon; the can has vents which allow the lid to be placed thereon without pneumatic back pressure restraining the lid from properly seating on the can; at the same time, for high speed lid placement certain camming arrangements have been provided to facilitate the lid being placed on the can and being seated properly thereon; considerable improvements in retained content freshness have been observed.

8 Claims, 6 Drawing Figures

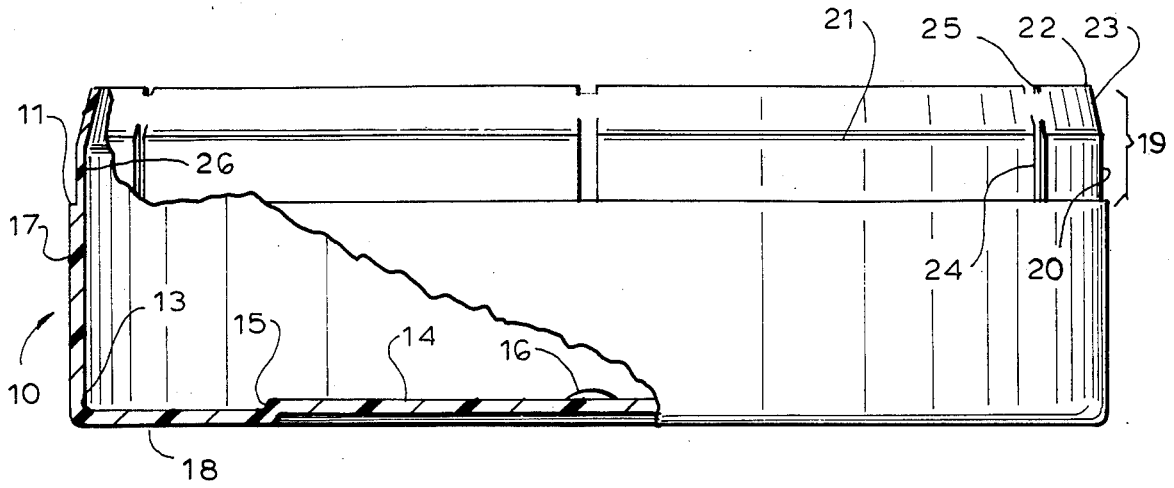
FIG. 1
FIG. 3
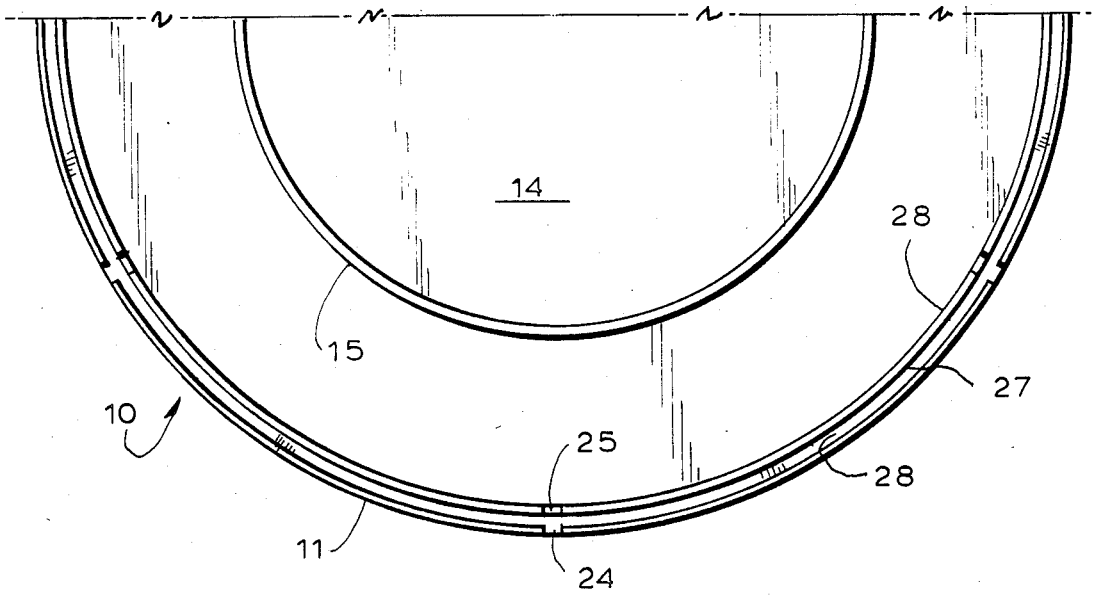

VENTED PLASTIC CAN AND TIN LID THEREFOR

This invention pertains to a plastic can especially designed to retain freshness of the contents and yet allow in the lidding operation to place easily a lid thereon; in this operation the lid vents the contents during the lidding without pneumatically restraining the lid from seating on the can. More specifically, this invention pertains to a novel vented plastic can with certain camming arrangements for a lidding machine to facilitate the lid being placed on the can and being seated on the can in such a manner that the contents thereof retain freshness for at least twice as long as heretofore has been observed with conventional cans used with the same goods.

With respect to the can and the goods therein, the novel can is conventionally employed for retaining contents thereof under moist conditions without allowing the contents to dry or to undergo spoilage.

BACKGROUND FOR THE INVENTION

In packaging material such as smokeless tobacco, it is important that the contents of the can retain their freshness and palatability for a given period of time. For this reason, typically the industry employs for high quality products a dating technique which allows the removal of products believed not to be fresh.

Typically various cans have been proposed for packaging these materials, and these cans have been either of the plastic type or lined paper with metal lids or metal cans.

It has, however, become increasingly clear that the product distribution cycles are immeasurably aided if larger quantities of goods may be produced at one time which would retain, if appropriately packed, their freshness in the container and thus be usefully sold over a longer period of time.

It has also been proposed that the can contents be sealed so as to retain their flavor and freshness. For this purpose, various sealing ribbons are placed on these cans, not only to assure the nonegress of foreign bodies, but also to give a badge of assurance that the contents have not been tampered with. These sealing devices, however, have to function in such a manner that the can and the lid are uniform in diameter, and at the same time allow the label placement thereon in a consistent manner, not edgewise offset one versus the other. Still further, the can contents in the past have suffered from the lack of freshness because of various product spoilage problems associated with improperly lidded or vented containers.

In a typical industrial application, the lidding operation is by a cam-roller which places the can lid in a rolling mode and distorts the cans. Often these lids are displaced improperly by this motion and loss of product results. The novel can construction provides for an improved can or minimizes the problems heretofore encountered with the prior art cans.

BRIEF DESCRIPTION OF THE PRESENT INVENTION

It has now been found that if the can and lid, in combination, are properly cooperating with the benefit being gained from the proper design of the can and the placement thereon of a lid during the lidding operation, then great advantages are being gained by the novel can, not only during the production cycle of the can itself, but also during the filling stage of the can, namely—during the lidding operation, the venting step during this lidding, ventilation of the contents while in storage, and the shelf life features of the can. Other considerations of importance are the weight of the can, the dimensions of the can walls, and the structural rigidity requirements to withstand the rapid fire production cycles and the transportation abuse often found for products of the type placed in cans.

The above-described problems have been solved or minimized and/or desirable features have now been displayed in the novel can and lid combination, as well as gained by the lidding of these cans.

DESCRIPTION OF THE INVENTION AND THE EMBODIMENTS THEREOF

Turning now to the drawings herein and the illustrations of embodiments of the invention thereby:

FIG. 1 illustrates in a partial cross-section in a side-view, the can with the novel elements incorporated in the can;

FIG. 3 illustrates a partial top-view of the embodiment shown in FIG. 1;

With reference to FIG. 1, the cross-sectional area of the can 10 is shown for a can made of a plastic material typically of a polypropylene material. Other suitable materials may also be employed and are within the contemplation of this invention, e.g., polyacetals; polyvinyls; polybutylenes, etc.

Figure 2:
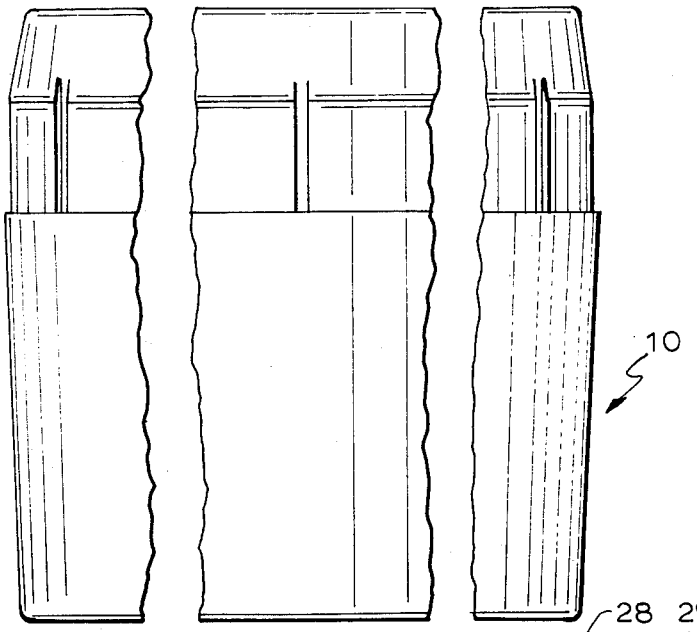
FIG. 2 illustrates an embodiment of the can in a side-view whereby the ratio of the body geometry thereof may be varied from the vertical vis-a-vis the horizontal relationship.

The can body is of various dimensions, as shown in FIG. 2, where the change in the ratio of the vertical and horizontal dimension has been suitably illustrated.

Figure 6:
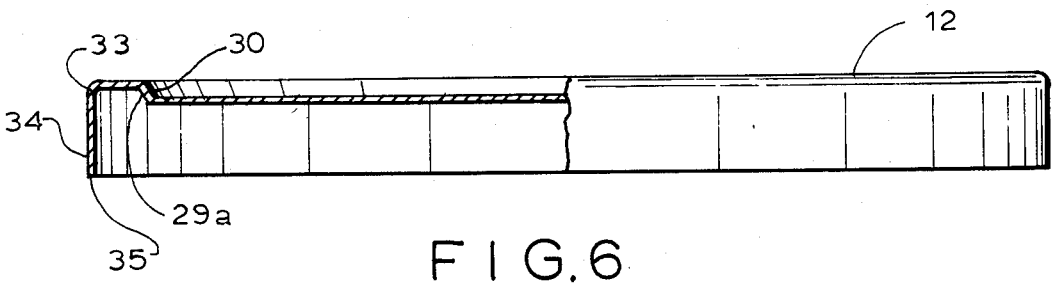
FIG. 6 illustrates in a side-view and in a partial section a typical lid used with the present can device.

In FIG. 1, the lid ledge or seating rim 11 for the can lid 12 shown in FIG. 6 is circumferentially recessed for the entire can as a ledge upon which the lid, at the completion of the lidding operation, may rest. This ledge 11 allows for an interference fit of the can lid 12 as further explained, and at the same time seats the lid 12 vertically upwardly in a smooth transition from the can body 10 to the lid 12 as defined by the vertical wall 17, i.e., in a straight line. However, in the event that greater degree of venting is required, the lid 12 may be sized so as not to sit on the ledge 11.

Typically the outside lower corners 13 of the can are filletted to provide for a pleasing appearance.

Offset indentation 14 with an offset section 15 at the bottom 18 of the can provides added rigidity to the can 10. The offset indentation 14 with the offset section 15 may be in multiples thereof, that is, for each offset indentation there may be two offset sections 15 and a plurality of offset indentations may be used.

Inasmuch as these cans are typically made by injection molding, a filler port 16 is used therefor. A number of filler ports may also be employed.

In order to provide a certain rigidity to the structure and also provide a pleasing appearance and yet accommodate the almost straight perpendicular line of the side wall 17 vis-a-vis the bottom wall 18, a one degree offset has been shown from the lid ledge 11 to the outside radius of corner 13 and bottom wall 18. Thus the can tapers slightly downwardly, i.e., by about one degree, and gives a very pleasing appearance. This taper has been accentuated in the embodiment shown in FIG. 2.

Turning now to the can body above the lid ledge 11 and identified by the bracket 19 as a lid receiving section, this portion of the can contributes greatly to the improved operation of the can in combination with the features further described herein. The lid receiving section 19 consists of the substantially straight can lid interference fit section designated as 20, terminating at a circle, i.e., point 21 in cross-section circumferentially around the can lid receiving section 19 with the upper part of the can lid receiving section 19 terminating at a taper point 22. The lid receiving section 19 thus in essence consists of a camming section 23, interference fit section 20 as defined between the points 22 and 11, that is, between the top of the can 28 (shown in FIG. 4) and the lid ledge 11. It has been found that an angle necessary to accomplish proper lidding and yet accomplish all of the desirable features previously mentioned must have a certain offset relationship vis-a-vis the straight part 20 of the lid receiving section 19 of the can. This relationship is expressed in terms of degrees and has been found by experience to be about 9 to 15 degrees, plus or minus two degrees. It has also been found to be necessary for proper removal of the can from the mold.

A relationship between the tapered section 23 and the straight section 20 has been found to be typically in the order of from 1:3 to 1:2, or even as low as 1.0:1.5.

During the lidding operation, one edge of the can 10 catches the lid 12 and then a cam-roller rolls and cams the lid 12 on the can. Therefore, it is important to have a proper tapered section 23 in a proper offset.

The venting columns 24 around the periphery of the straight section 20 (also called venting notches) are placed at appropriate intervals. It has been found by experience for the embodiment shown in FIG. 1 that at least six venting columns are appropriate of a size suitable for the contents of the can of 2½ to 3 inches in diameter and from 1 to 1¼ inches in height illustrated in FIG. 1 when used for smokeless tobacco. These venting columns may be wider or narrower, but are based on a relationship which is based on the total contents of the can. Hence, the proper design may require the introduction of additional or wider venting columns 24 to accomplish the proper venting.

In combination with venting columns 24, venting notches 25 are used. These venting notches are important in that the final venting and the pneumatic resistance is best overcome in the final seating operation by these small venting notches 25. The number of these may correspond to venting columns 24, because in the instant before the final seating of the lid 12 on the lid ledge 11, the venting notches allow the final expulsion of the gas through the bottom of the venting columns 24. These venting notches 25 and venting columns 25 are as a result of the number and placement independent of can orientation during the lidding operation.

Moreover, a small permeable material ribbon (not shown) may be placed around the can for further controlling the venting. Such permeable materials may be paper nonwoven materials, e.g., polypropylene, polyethylene, etc., and the like, of predetermined permeability properties.

Figure 4:
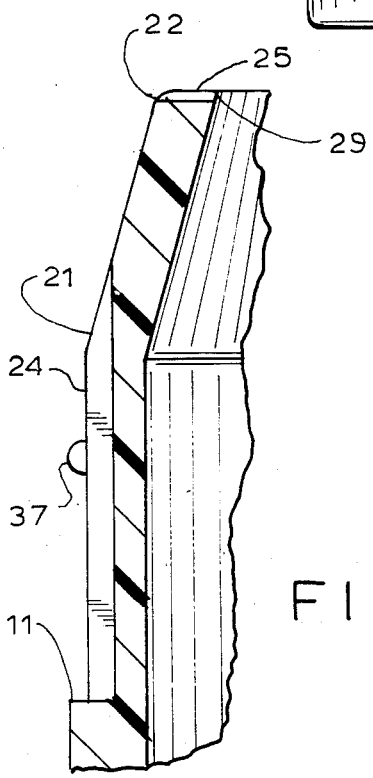
FIG. 4 illustrates, in partial cross-section, the novel wall which facilitates the lidding and venting.

For the enlarged lid receiving section 19 shown in FIG. 4, the relationship of the section wall has been shown vis-a-vis the side wall 17. The lid receiving section 19 has a wall 26 which is thinner than the side wall 17 in a ratio of about 2:3. The added rigidity imparted to the lid receiving section 19 is achieved by the lid 12 shown in FIG. 5. The section wall 26, as discussed before, has an offset camming section 23 of equal thickness to the section 20. The upper part 23 has a filletted corner 27. This filletted corner serves to smooth the entry of the lid 12 without the lid 12 hanging up on the upper surface 28 of wall 23. The inner corner 29, however, terminates in a point and serves to achieve a substantially airtight seal with the lid 12 shown in FIG. 6, except for the specifically designed venting notches 25. However, an interference rim 37 may further be used; it also has notches 24 therein to facilitate venting. This interference rim 37 may be an addition for the lid interference fit section 20. However, rim 37 is a less desirable manner for venting the contents and for seating a lid, even if used with venting notches or venting columns 24 and 25 or merely equivalent gaps in the rim 37.

Figure 5:
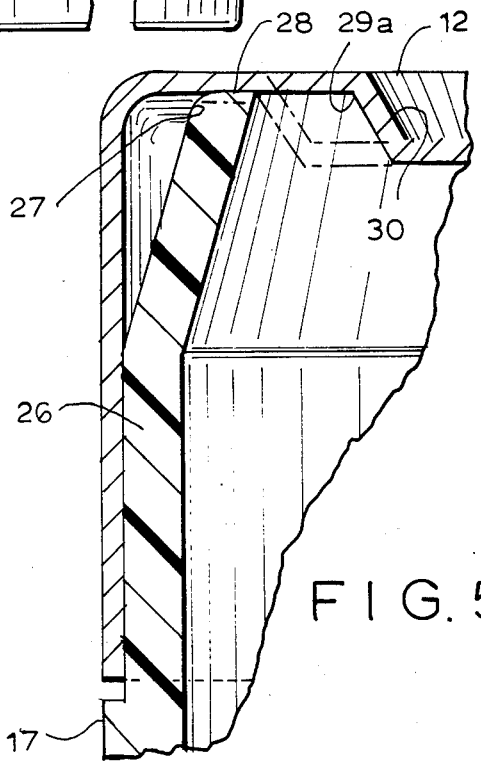
FIG. 5 illustrates the novel venting-camming arrangement in cross-section as a partial section of the can and lid.

Turning now to FIG. 5, as the lid 12 cooperates with the corner 29, it is noted that in an embodiment the corner 29 fits into the corner **29*a* of lid 12 in a substantially firm engagement, and this engagement, in combination with the lid offset section 30 and lid recess 31 provides the important sealing function which is aided further by the resilience of the section 23 and 20 vis-a-vis the can wall 17 and the lid section defined by the fillet 33 on the side wall 34. Thus in the phantom illustration in FIG. 5, the distance between 33 and 29*a* on the lid 12 defines a section in which the upper surfaces 28 of the can defined by the filletted rim 27 and the point 29 are engaged with the point 29 snugly inserted at point 29*a* on the lid 12. Of course, the rim defined by point 29 may be placed short of point 29, i.e., against the underside of the lid but not against 29*a*. That embodiment allows for greater venting. An angle of about 25 to 30 for the offset section 30** (away from perpendicular) establishes a sufficient seal not displaced by movement in the distribution cycle or during storage, e.g., in a warehouse or on a store shelf or even during carrying in a pocket.

A resilience by the lid receiving section 19 is also a contributing factor to the tightly interference-fit lid 12 and the location thereof, as well as the positive engagement and venting accomplished with venting notches 25 and venting columns 24. The resilience thus contributes also in the injection molding stage as the ejection of the can is not a problem due to the excellent resilience of the lid receiving section 19 vis-a-vis the side wall 17.

In addition to the above, this arrangement allows the reduction of the weight of the can in such a manner that the improved lid and can body cooperation gives the rigidity and improvement in the can performance without undue flexing, that is, with minimum flexing and yet with excellent rigidity behavior of the entire can and still more importantly with a reduction in can weight.

Typically the lid 12 consists of a metal which is tin-coated and lacquered on the inside and outside of the can.

It has also been found that the wall thickness dimensions of the lid being about from 0.008 to 0.012 plus or minus 0.002 allows the metal lid to be sufficiently rigid and yet at the same time sufficiently light to accomplish the lidding. At the same time, this thickness provides the necessary venting function and the seating function for variously sized cans.

With respect to the thickness of the venting columns which are also sometimes called venting slots 24, these are typically about 0.0040 inches. Similarly, the venting notches 25 are also typically about 0.0040 inches deep.

Thus the depth of the venting column 24 is 0.0014 vis-a-vis the wall which in lid receiving section 19 is about 0.0275 which is in a ratio of about 1:2, but may range in ratio of from 1:2 to 1:6.

The venting notch relationship in a cross-section has been shown in FIG. 5 with the venting notch 25 shown at the top of FIG. 5 and the venting column 24 shown on the lefthand side of FIG. 4.

As seen from FIGS. 4 and 5, the section between the point 21 and 22 provides for the venting when nearly all of the lid has been seated on the lid ledge 11, but while one side of the bottom 35 of the lid 12 is only slightly away from the lid ledge 11. The venting notch 25 and 24 are still capable of communicating with the lid ledge 11 and lid bottom 35 shortly before the final seating without pneumatic back pressure being built up in the can and subsequent displacement of the lid because of it.

Based on the above description of the embodiments, it is clear that the venting slots contribute greatly to the ventilation while the can is in storage by providing an appropriate thickness for the can such as shown by the lid side wall 34 which may be less than the lid receiving section 19 shown in FIG. 1 with the upper surface 28 resting on the lid between the points 33 and 29*a* and the venting notch 25. The venting notch 25 depth, if necessary, may be greater or less, and thus allows the ventilation of goods which are being placed in the can. It is well known that different ventilation requirements are needed for different goods.

The camming action of the lid receiving section 19 vis-a-vis the lid 12 also allows the point 29 to engage sufficiently tightly, as necessary, the lid 12 at point 29*a* and at the wall section 20 and thus provide the necessary seating rigidity and behavior of the can under the conditions such as in transport, storage and while the goods are being stored on a shelf (for improved shelf-life).

The shelf life improvement has been observed to be from about 100 percent in terms of a typical content such as found when smokeless tobacco of the type commonly known under the trademarks SKOAL or COPENHAGEN is being distributed and stored in the present can container for sale. Other like improvements are anticipated with other goods packed in these cans.

Having described the above embodiments, what is claimed is defined by the appended claims:

1. As an article of manufacture, a plastic can suitable for receiving a lid for closing said can comprising: a side wall, a lid receiving section and a bottom wall wherein said lid receiving section has a side wall of a reduced thickness from that of the side wall; a ledge at the bottom of said lid receiving section; an interference fit section between said ledge and a top of said lid receiving section; a lid camming section between said interference fit section and said top of said lid receiving section; a plurality of venting slots in said interference fit section and at the bottom of said lid camming section; a plurality of slots in said lid camming section within the top surface thereof; an outer rim for said top surface; and a pointed inner rim defined between an inner surface of said lid camming section and said top surface for said lid camming section.

2. The article as defined in claim 1 wherein a seated lid is on top surface of said lid receiving section.

3. The article as defined in claim 1 wherein a seated lid is on said ledge of said lid receiving section.

4. The article as defined in claim 1 wherein the top surface of said lid receiving section abutts against an offset rim on a lid at an underside of said lid at an intersection between said offset rim and at an underside of a lid surface.

5. The article as defined in claim 1 wherein the lid camming section is at an angle of 7° to 15° away from a perpendicular and inwardly from a side wall of said can.

6. The article as defined in claim 1 wherein said interference fit section for said lid section includes at least one rib circumferentially thereof.

7. The article as defined in claim 6 wherein said rib is half round with venting slots in said rib.

8. In a method for lidding a can such as a plastic can with a metal lid, the improvement comprising:

camming said lid on said can at an initiation catch point on one side of said can independent of an orientation of said can, wherein the lid is oriented at an angle away from the horizontal surface of said can;

progressively seating, by force, said lid on said can;

progressively relieving pneumatic back-pressure in said can while said lid is being seated; and predeterminedly venting said can for desired venting purposes.

* * * * *